United States Patent [19]

Yoshida et al.

[11] Patent Number: 5,041,354

[45] Date of Patent: Aug. 20, 1991

[54] PHOTOSENSITIVE MATERIAL FOR TRANSFER PROCESS

[75] Inventors: Akio Yoshida; Susumu Baba; Yasuo Tsubai, all of Nagaokakyo, Japan

[73] Assignee: Mitsubishi Paper Mills Limited, Tokyo, Japan

[21] Appl. No.: 437,633

[22] Filed: Nov. 17, 1989

[30] Foreign Application Priority Data

Jun. 16, 1989 [JP] Japan ..... 1-153787

[51] Int. Cl.[5] ..... G03C 5/54

[52] U.S. Cl. ..... 430/244; 430/227; 430/230; 430/249

[58] Field of Search ..... 430/204, 206, 222, 230, 430/244, 249

[56] References Cited

U.S. PATENT DOCUMENTS

| | | | |
|---|---|---|---|
| 2,834,676 | 5/1958 | Stanley et al. | 430/244 |
| 2,962,377 | 1/1960 | Land | 430/244 |
| 3,300,306 | 1/1967 | Sevens et al. | 430/204 |
| 4,302,526 | 11/1981 | Kohmura et al. | 430/230 |
| 4,562,140 | 12/1985 | Kohmura et al. | 430/230 |
| 4,606,985 | 8/1986 | Takaya et al. | 430/204 |
| 4,632,896 | 12/1986 | Tsubai et al. | 430/244 |
| 4,743,525 | 5/1988 | Yamamoto et al. | 430/204 |
| 4,824,760 | 4/1989 | Yamamoto et al. | 430/204 |
| 4,873,170 | 10/1989 | Nishinoiri et al. | 430/204 |

*Primary Examiner*—Richard L. Schilling

*Attorney, Agent, or Firm*—Cushman, Darby & Cushman

[57] ABSTRACT

A photosensitive material for diffusion transfer process is disclosed which is superior in image reproducibility and running property of when processed with a processing solution for silver complex diffusion transfer process. This photosensitive material is characterized in that total binder amount on the silver halide emulsion coated side of the photosensitive material is 6–8 g/m$^2$ and when the silver halide emulsion coated side of the photosensitive material is immersed in a 0.1N aqueous sodium hydroxide solution at 20° C. for 1 minute, amount of the solution absorbed and the total binder amount on the emulsion coated side is 3.5:1–5.5:1.

6 Claims, No Drawings

PHOTOSENSITIVE MATERIAL FOR TRANSFER PROCESS

BACKGROUND OF THE INVENTION

The present invention relates to a diffusion transfer material and in particular to a photosensitive material for silver complex diffusion transfer process.

Theory of silver complex diffusion transfer process (hereinafter referred to as "DTR process") is mentioned in U.S. Pat. No. 2,352,014 and is known.

According to DTR process, imagewise exposed silver halide emulsion layer is brought into close contact with an image receiving layer in the presence of a developing agent and a silver halide solvent. In the exposed portion of silver halide emulsion layer, silver halide is developed to silver (chemical development) and so is no longer dissolved and cannot diffuse In the unexposed portion, silver halide is converted to a soluble silver complex salt, which is transferred to the image receiving layer, where it forms silver image usually in the presence of physical development nuclei.

Advantage of DTR process is that super-high contrast and dot reproducibility comparable to those of commercially available lith film can be obtained by superposing a photosensitive material for diffusion transfer process and an image receiving layer on each other in a DTR processing solution by a simple processor and besides maintenance of processing solution is easier than in lith system.

DTR process is superior in simplicity of processing as mentioned-above, but with progress of use of the processing solution, exhaustion of the processing solution proceeds to cause reduction of density and lowering of contrast of the resulting image.

Recently, it has been demanded that the processing solution for such DTR process has durability and various investigations have been made. These are disclosed, for example, in Japanese Patent Kokai Nos. 60-212760, 60-212761, 61-73949, 61-73950, 61-73951, 61-73952, 61-73953, and 61-73954.

Furthermore, attempt to improve running processing characteristics by improving photosensitive material for diffusion transfer process has also been proposed and, for example, Japanese Patent Kokai No. 61-238055 has proposed a method therefor.

Such DTR process is often used for preparation of block copies for plate making and for proof and especially, when it is used for the former use, image reproducibility is important and attempts to improve image reproducibility has also been made for photosensitive materials for diffusion transfer process.

The inventors have conducted research to improve image reproducibility and running processing characteristics and have found that image reproducibility and running processing characteristics can be improved when total binder amount in photographic layers on the silver halide emulsion coated side of photosensitive material for diffusion transfer process is adjusted to 6≅8 g/m$^2$ and ratio of amount of solution absorbed in the layers on the emulsion coated side and the total binder amount on the emulsion coated side in case the silver halide emulsion coated side is immersed in a 0.1N aqueous sodium hydroxide solution at 20° C. for 1 minute is adjusted to 3.5:1–5.5:1.

SUMMARY OF THE INVENTION

An object of the present invention is to provide a photosensitive material for diffusion transfer process which is superior in image reproducibility, good in running processing characteristics with use of processing compositions for DTR and causing less reduction of density and decrease in contrast of image with use of exhaust processing solution.

Other objects will be clear from the following disclosures.

DESCRIPTION OF THE INVENTION

The photosensitive material for diffusion transfer of the present invention is characterized in that total amount of binder in the photographic layers on the silver halide emulsion coated side of the material is 6–8 g/m$^2$ and when layers on the silver halide emulsion coated side is immersed in a 0.1N aqueous sodium hydroxide solution at 20° C. for 1 minute, ratio of amount of solution absorbed in the photographic layers on the emulsion coated side and the total amount of binder on the emulsion coated side is 3.5:1–5.5:1. The ratio of amount of solution absorbed and total amount of binder on the emulsion coated side is hereinafter referred to as "swelling ratio".

If the total amount of binder is less than 6 gm$^2$ or/and the swelling ratio is more than 5.5:1, material excellent in image reproducibility cannot be obtained.

If the total amount of binder is more than 8 g/m$^2$ or/and the swelling ratio is less than 3.5:1, reduction of density or decrease in contrast of image with exhausted processing solution are apt to occur and the material is inferior in running processing characteristics.

It has been found that image reproducibility and running processing characteristics can be simultaneously improved by adjusting the total binder amount on the silver halide emulsion coated side of the support and the swelling ratio to the ranges as mentioned above.

Factors for obtaining such film properties as mentioned above are amount of hardener added, pH of coating composition, drying conditions at coating, heating conditions after coating, etc. and these have correlations, but such materials can be prepared by methods known for one skilled in the art.

The silver halide used in the present invention may be any ones, for example, silver chloride, silver bromide, silver chlorobromide and these silver halides combined with silver iodide.

The silver halide used in the present invention is preferably silver chlorobromide or silver chloroiodobromide containing 1–4 mol% of bromide. Silver halide containing less than 1 mol% of bromide gives low density and silver halide containing more than 4 mol % of bromide causes inferior running processing characteristics and reduction of image density and decrease of contrast with use of exhausted processing solution.

In the present invention, known hardener can be added to any layers on the emulsion coated side as far as swelling ratio can be adjusted to the range of 3.5:1–5.5:1. The known hardeners include, for example, methylol compounds such as 2,4-dichloro-6-hydroxy-S-triazine salt, glyoxal, formalin, malealdehyde, and ethyleneurea, mucochloric acid, and 2,3-dihdyroxy1,4-dioxane.

In the present invention, pH of the silver halide emulsion is preferably 4.5 or less, which affords photosensitive materials for diffusion transfer excellent in stability with time (shelf stability) and less in unevenness in dots.

Hydrophilic binders advantageously usable for preparation of photosensitive emulsion include, for example, proteins such as lime-treated gelatin, acid-treated gelatin, gelatin derivatives (such as those which are disclosed in Japanese Patent Kokoku Nos. 38-4854, 39-5514, 40-12237, and 42-26345, U.S. Pat. Nos. 2,525,753, 2,594,293, 2,614,928, 2,763,639, 3,118,766, 3,132,945, 3,186,846, and 3,312,553, and British Patent Nos. 861,414 and 1,033,186), albumin, and casein, cellulose compounds such a carboxymethylcellulose and hydroxyethylcellulose, natural polymers such as agar and sodium alginate, synthetic hydrophilic binders such as polyvinyl alcohol, poly-N-vinylpyrrolidone, polyacrylic acid copolymers, polyacrylamide or derivatives or partial hydrolysates thereof. These hydrophilic binders may be used alone or in combination. Furthermore, these hydrophilic binders may also be advantageously used for preparation of non-photosensitive layers such as antihalation layer, interlayer, protective layer (or releasing layer), backing layer and image receiving layer.

Binder used in silver halide emulsion layer is used in an amount (in terms of silver nitrate) of 0.3–5, preferably 0.5–3 in weight ratio to silver halide.

The silver halide may be any ones, for example, silver chloride, silver bromide, silver chlorobromide and these silver halides combined with silver iodide.

Silver halide emulsion may be spectrally sensitized to blue, green and red with sensitizing dyes such as merocyanine, cyanine dyes and the like.

Furthermore, the silver halide emulsion may be chemically sensitized with various sensitizing agents, for example, sulfur sensitizing agents (such as hypo, thiourea, and gelatin containing unstable sulfur), noble metal sensitizing agents (such as gold chloride, gold thiocyanate, ammonium chloroplatinate, silver nitrate, silver chloride, palladium salts, rhodium salts, iridium salts and ruthenium salts), polyalkylenepolyamine compounds mentioned in U.S. Pat. No. 2,518,698, iminoamino-methanesulfinic acid mentioned in German Patent No. 1,020,864, and the reduction sensitizing agents (such as stannous chloride).

The backing layer which is desirably provided on backside of support contains hydrophilic colloid in an amount necessary to keep balance in curl with the photosensitive layer side. The amount depends on total amount of hydrophilic colloid on the photosensitive layer side and amount of white inorganic pigment.

When the silver halide emulsion layer is combined with an antihalation layer containing a black pigment, image reproducibility can be improved.

Also when the silver halide emulsion layer is combined with an antihalation layer in which the black pigment and the white pigment are used in combination, image reproducibility can be improved.

The constituting elements of the diffusion transfer photosensitive material of the present invention may further contain various additives as exemplified below.

Antifoggants and stabilizers such as mercapto compounds and tetrazeindene, surface active agents, e.g., anionic compounds such as saponin, sodium alkylbenzenesulfonate, sulfosuccinic acid esters, and alkylarylsulfonates as disclosed in U.S. Pat. No. 2,600,831 and amphoteric compounds as disclosed in U.S. Pat. No. 3,133,816, and besides, wetting agents such as wax, polyol compounds, glycerides of higher fatty acids and esters of higher alcohols, mordants such as N-guanylhydrazone compounds, quaternary onium compounds and tertiary amine compounds, antistatic agents such as diacetyl cellulose, styrene-perfluoroalkylene sodium maleate copolymer, and alkali salts of reaction products of styrene-maleic anhydride copolymer with p-aminobenzenesulfonic acid, matting agents such as polymethacrylic acid esters, polystyrene, and colloidal silica, film property modifiers such as acrylic acid esters and various latexes, thickening agents such as styrene-maleic acid copolymer and those disclosed in Japanese Patent Kokoku No. 36-21574, antioxidants, developing agents, and pH adjustors.

A plurality of hydrophilic colloid layers may be coated separately or simultaneously. Coating method is not critical and any known methods may be employed.

Processing solution used for diffusion transfer process may contain alkaline materials such as sodium hydroxide, potassium hydroxide, lithium hydroxide, and tribasic sodium phosphate; silver halide solvents such as sodium thiosulfate, ammonium thiocyanate, cyclic imide compounds, and thiosalicylic acid; preservatives such as sodium sulfite; thickening agents such as hydroxyethyl cellulose and carboxymethyl cellulose; antifoggants such as potassium bromide and 1-phenyl-5-mercaptotetrazole; development modifiers such as polyoxyalkylene compounds and onium compounds; developing agents such as hydroquinone and 1-phenyl-3-pyrazolidone; and alkanol amines.

However, in the high-alkali processing solution containing developing agent, there is the defect that the developing agent undergoes oxidation with air to lose activity. This defect can be greatly improved by containing the developing agent in DTR material, namely, in silver halide emulsion layer and/or a hydrophilic colloid layer which are permeable to water.

In case of such diffusion transfer material containing developing agent, alkali activation solution containing no or substantially no developing agent is normally used.

Japanese Patent Kokoku Nos. 39-27568, 47-30856 and 51-43778 can be referred to for DTR process which uses the alkali activation solution.

The present invention will be illustrated by the following nonlimiting examples.

EXAMPLE 1

An aqueous solution of sodium chloride and potassium bromide and an aqueous solution of silver nitrate were simultaneously added at a rate of 5 ml/min to an aqueous solution of inert gelatin kept at 60° C. with vigorous stirring to obtain a silver chlorobromide emulsion containing 2% of bromide. The silver halide grains were in cubic form in habit and had an average particle size of 0.32 $\mu$ and 90% by weight or more of the total grains were included within ±30% of the average grain size.

The emulsion was precipitated and washed with water and redissolved and then was subjected to sulfur sensitization and gold sensitization with sodium thiosulfate and potassium chloroaurate. To the resulting emulsion was added a sensitizing dye to carry out orthochromatic sensitization and a surface active agent was added thereto to finish preparation of emulsion.

On one side of a paper support of 110 g/m$^2$ coated with polyethylene on both sides was provided an undercoat layer comprising 4 g/m$^2$ of gelatin containing 0.5 g/m$^2$ of carbon black, 1.0 g/m$^2$ of hydroquinone and 0.2 g/m² of 1-phenyl-4,4-dimethyl-3-pyrazolidone as an antihalation layer and on this undercoat layer was provided an emulsion layer comprising the above finished emulsion containing compound (A) in an amount as shown in Table 1-1 as a hardener so that amount of coated silver was 1.3 g/m² and amount of coated gelatin was 2.5 g/m².

The undercoat layer and the emulsion layer both had a pH of 4.0. On the opposite side (back side) of the support was provided a gelatin layer necessary to control curling and having a pH of 4.5. After drying, the samples were heated as shown in Table 1-1.

These samples were exposed through a wedge which differed stepwise in density by 0.05 each. Each of these samples was brought into close contact with an image receiving material, MITSUBISHI ONE STEP PC and passed through a customary processor having the following diffusion transfer processing solution and after 60 seconds, they were separated from each other. Processing temperature was 25° C.

| Diffusion transfer processing solution: | |
|---|---|
| Water | 800 ml |
| Sodium tertiary phosphate ($12H_2O$) | 75 g |
| Anhydrous sodium sulfite | 40 g |
| Potassium hydroxide | 5 g |
| Sodium thiosulfate ($5H_2O$) | 20 g |
| Potassium bromide | 1 g |
| 1-Phenyl-5-mercapto-tetrazole | 0.1 g |
| Water to make up one liter in total. | |

As the processing solution, a fresh solution and a model exhausted solution, pH of which was adjusted to 10.5 with sulfuric acid were used. NaOH solution at 20° C. for 1 minute and amount of the solution absorbed in the layers on the emulsion layer side was calculated from difference in weight before and after immersion. The results are shown in Table 1-1 together with results of sensitometry.

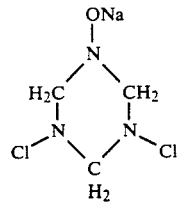

Compound (A)

In the above table, $D_T$ means transmission density and L is difference between logarithm of relative exposure at minimum density +0.02 and logarithm of relative exposure at density of 2.0.

As can be seen from Table 1-1, Samples 2 and 3 of the present invention gave $D_T$ of 3.0 even with the model exhausted processing solution and showed less decrease of density while Sample 4 gave $D_T$ of 2.2 and showed considerable reduction in contrast. Sample 1 gave poor image owing to peeling of layers and could not be practically used.

From this Example, it is clear that photosensitive materials for diffusion transfer process which was adjusted to swelling ratio: 3.5:1–5.5:1 according to the present invention are superior in running processing characteristics.

Next, an original comprising fine lines having widths of 10 μ, 20 μ, 30 μ, . . . , 100 μ in equal difference of 10 μ, was photographed using Samples 1–4 by a process camera ARTGRAPHICA 601 II manufactured by Dainippon Screen Mfg. Co., Ltd. and the samples were subjected to the same treatments as above to obtain fine line images. The results are shown in Table 1-2.

As can be seen from Table 1-2, Sample 1 was inferior in image reproducibility, but Samples 2 and 3 were superior in image reproducibility.

TABLE 1-2

| Sample No. | Amount of hardener and heating condition | Amount of absorbed solution g/m² | Swelling ratio | Minimum line width of original which can be reproduced: Positive lines | Negative lines |
|---|---|---|---|---|---|
| 1 | 50 mg/m², no heating | 40.3 | 6.2:1 | 40 μ | 40 μ |
| 2 | 50 mg/m², 40° C. 60% RH 6 days | 34.5 | 5.3:1 | 30 μ | 30 μ |
| 3 | 50 mg/m², 40° C. 60% RH 6 days | 27.3 | 4.2:1 | 30 μ | 30 μ |
| 4 | 50 mg/m², 50° C. 80% RH 6 days | 20.8 | 3.2:1 | 30 μ | 30 μ |

From the above, it has been found that the photosensitive materials for diffusion transfer process according to the present invention are superior in image reproducibility and running processing characteristics.

EXAMPLE 2

This Example shows influence of halogen composition of silver halide emulsion.

Silver chlorobromide emulsions containing 0.5 mol %, 1 mol %, 2 mol % and 5 mol % of bromide were

TABLE 1-1

| Sample No. | Amount of hardener and heating condition | Amount of absorbed solution g/m² | Swelling ratio | Fresh solution: $D_T$ | L | Model exhausted solution: $D_T$ | L |
|---|---|---|---|---|---|---|---|
| 1 | 50 mg/m², no heating | 40.3 | 6.2:1 | 3.4 | .31 | 3.1 | .38 |
| 2 | 50 mg/m², 40° C. 60% RH 6 days | 34.5 | 5.3:1 | 3.5 | .32 | 3.0 | .40 |
| 3 | 50 mg/m², 40° C. 60% RH 6 days | 27.3 | 4.2:1 | 3.5 | .32 | 3.0 | .41 |
| 4 | 50 mg/m², 50° C. 80% RH 6 days | 20.8 | 3.2:1 | 3.5 | .32 | 2.2 | .68 |

prepared in the same manner as in Example 1. These emulsion grains had an average grain size of 0.32 μ and were in cubic form, at least 90% by weight of total grains having a grain size within the range of ±30% of the average grain size.

Samples were prepared and evaluated in the same manner as in Example 1 except that compound (B) was added as a hardener so that coating amount thereof was 10 mg/m². The samples were heated at 40° C. for 6 days. The results are shown in Table 2.

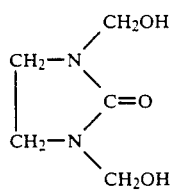

Compound (B)

TABLE 2

| Sample No. | Amount of bromide | Amount of absorbed solution | Swelling ratio | Fresh solution $D_T$ | Fresh solution L | Model exhausted solution $D_T$ | Model exhausted solution L |
|---|---|---|---|---|---|---|---|
| 5 | 0.5 mol % | 29.3 g/m² | 4.5:1 | 3.1 | .30 | 2.7 | .37 |
| 6 | 1 | 29.9 | 4.6:1 | 3.4 | .31 | 3.0 | .38 |
| 7 | 2 | 29.2 | 4.5:1 | 3.5 | .32 | 3.1 | .40 |
| 8 | 5 | 29.4 | 4.5:1 | 3.3 | .35 | 2.6 | .50 |

As is clear from Table 2, in Samples 6 and 7 which contained 1–4 mol % of bromide, reduction of density was small and density was excellent while in Sample 8, reduction of density was great and in Sample 5, density was low when a fresh solution was used. Thus, the latter two samples were inferior. Therefore, silver chlorobromide emulsion and silver chloroiodobromide emulsion containing 1–4 mol % of bromide are preferred embodiments and it has become clear that photosensitive materials which used these emulsions were superior in running processing characteristics.

EXAMPLE 3

This Example shows influence of total binder amount in the layers on the emulsion coated side. Samples were prepared in the same manner as in Example 1 except that amount of gelatin in the undercoat layer was set as shown in Table 3-1 and these samples were subjected to sensitometry. The results are shown in Table 3-1. Amount of hardener added was 50 mg/m² and heating was conducted at 40° C. under 60% RH for 6 days.

Then, reproducibility of fine lines was examined using a process camera in the same manner as in Example 1 and the results are shown in Table 3-2.

TABLE 3-1

| Sample No. | Amount of binder on the emulsion coated side: Undercoat | Amount of binder on the emulsion coated side: Total | Amount of absorbed solution | Swelling ratio | Fresh solution $D_T$ | Fresh solution L | Model exhaused solution $D_T$ | Model exhaused solution L |
|---|---|---|---|---|---|---|---|---|
| 9 | 3 g/m² | 5.5 g/m² | 20.9 g/m² | 3.8:1 | 3.0 | .28 | 2.8 | .32 |
| 10 | 4 | 6.5 | 27.3 | 4.2:1 | 3.5 | .32 | 3.0 | .41 |
| 11 | 5 | 7.5 | 35.5 | 4.6:1 | 3.5 | .36 | 2.9 | .48 |
| 12 | 6 | 8.5 | 44.2 | 5.2:1 | 3.0 | .39 | 1.9 | .69 |

TABLE 3-2

| Sample No. | Amount of binder on the emulsion coated side: Undercoat | Amount of binder on the emulsion coated side: Total | Amount of absorbed solution | Swelling ratio | Minimum line width of original which can be reproduced: Positive line | Minimum line width of original which can be reproduced: Negative line |
|---|---|---|---|---|---|---|
| 9 | 3 g/m³ | 5.5 g/m³ | 20.9 g/m³ | 3.8:1 | 40 μ | 40 μ |
| 10 | 4 | 6.5 | 27.3 | 4.2:1 | 30 μ | 30 μ |
| 11 | 5 | 7.5 | 35.5 | 4.6:1 | 30 μ | 30 μ |
| 12 | 6 | 8.5 | 44.2 | 5.2:1 | 30 μ | 40 μ |

As is clear from Table 3-1, in Samples 9 and 12, $D_T$ with fresh solution was low and reduction of $D_T$ with model exhausted solution was great and thus they were inferior in running processing characteristics while in Samples 10 and 11 of the present invention, $D_T$ was high with fresh solution and reduction of $D_T$ was small with model exhausted solution and they were excellent in running processing characteristics. Furthermore, as is clear from Table 3-2, Sample 9 was inferior in reproducibility of fine lines while Samples 10 and 11 were superior in image reproducibility.

As explained above, the photosensitive materials for diffusion transfer process according to the present invention are superior in image reproducibility and running processing characteristics.

What is claimed is:

1. A process for image formation which comprises imagewise exposing a photosensitive material which comprises a support and a silver halide emulsion layer coated thereon and which is processed in contact with an image receiving material in a processing solution for silver complex diffusion transfer process and separation of these two materials from each other wherein total binder amount in the layer on the silver halide emulsion coated side of the photosensitive material is 6–8 g/m² and when the silver halide emulsion coated side of the photosensitive material is immersed in a 0.1N aqueous sodium hydroxide solution at 20° C. for 1 minute, weight ratio of amount of the solution absorbed in the layer and the total binder amount on the emulsion coated side is 3.5:1–5.5:1.

2. The process for image formations according to claim 1, wherein the silver halide is silver chlorobromide or silver chloroiodobromide which contains 1–4 mol % of bromide.

3. The process for image formation according to claim 1, wherein the silver halide emulsion has a pH of 4.5 or less.

4. The process for image formation according to claim 1, wherein the silver halide emulsion layer contains binder in weight ration of 0.3–5 to silver halide in terms of silver nitrate.

5. The process for image formation according to claim 1, wherein the photosensitive material has a backing layer on the back side of the support.

6. The process for image formation according to claim 1, wherein the photosensitive material has an antihalation layer containing at least one pigment selected from the group consisting of a black pigment and a white pigment in combination with the silver halide emulsion layer.

* * * * *